United States Patent [19]

Kaneko

[11] Patent Number: 4,562,763

[45] Date of Patent: Jan. 7, 1986

[54] WAVEFORM INFORMATION GENERATING SYSTEM

[75] Inventor: Youzi Kaneko, Tokyo, Japan

[73] Assignee: Casio Computer Co., Ltd., Tokyo, Japan

[21] Appl. No.: 570,903

[22] Filed: Jan. 16, 1984

[30] Foreign Application Priority Data

Jan. 28, 1983 [JP] Japan ..... 58-13377

[51] Int. Cl.[4] ..... G10H 1/057; G10H 7/00

[52] U.S. Cl. ..... 84/1.01; 84/1.19; 84/1.26

[58] Field of Search ..... 84/1.01, 1.11–1.13, 84/1.19–1.27

[56] References Cited

U.S. PATENT DOCUMENTS

| | | | |
|---|---|---|---|
| 3,362,934 | 8/1967 | Deutsch . | |
| 4,079,651 | 3/1978 | Matsui . | |
| 4,183,275 | 1/1980 | Niimi et al. | 84/1.01 |
| 4,214,500 | 7/1980 | Adachi et al. | 84/1.01 |
| 4,223,582 | 9/1980 | Kato et al. | 84/1.01 |
| 4,258,602 | 3/1981 | Niimi et al. | 84/1.01 |
| 4,362,934 | 12/1982 | McLey . | |
| 4,416,178 | 11/1983 | Ishida . | |

FOREIGN PATENT DOCUMENTS

| | | |
|---|---|---|
| 2518633 | 10/1975 | Fed. Rep. of Germany . |
| 2709560 | 9/1977 | Fed. Rep. of Germany . |
| 3023478 | 1/1981 | Fed. Rep. of Germany . |
| 3150853 | 7/1982 | Fed. Rep. of Germany . |
| 1479116 | 7/1977 | United Kingdom . |
| 2025175A | 1/1980 | United Kingdom . |
| 1587214 | 4/1981 | United Kingdom . |
| 2078455A | 6/1982 | United Kingdom . |

*Primary Examiner*—S. J. Witkowski

*Attorney, Agent, or Firm*—Frishauf, Holtz, Goodman & Woodward

[57] ABSTRACT

A waveform step counter receives an output clock from a tone clock generator and an envelope status signal from an envelope counter. The waveform step counter generates an address signal for performing predetermined address skip, and a waveform memory is accessed in accordance with this address signal. Since the address signal performs the predetermined address skip, waveform information read out from the waveform memory indicates a timbre different from the original information stored in the memory.

6 Claims, 9 Drawing Figures

| ECM | WAVE FORM ADDRESS SIGNAL | | | | | OUTPUT | |
|---|---|---|---|---|---|---|---|
| | | | | | | $q_{61}$ | $q_{62}$ |
| 1 | (0) | 0 | 0 | 0 | 0 | 1 | 0 |
| | (2) | 0 | 0 | 1 | 0 | 1 | 0 |
| | (4) | 0 | 1 | 0 | 0 | 1 | 0 |
| | (6) | 0 | 1 | 1 | 0 | 1 | 0 |
| | (8) | 1 | 0 | 0 | 0 | 0 | 1 |
| | (9) | 1 | 0 | 0 | 1 | 0 | 1 |
| | (10) | 1 | 0 | 1 | 0 | 0 | 1 |
| | (11) | 1 | 0 | 1 | 1 | 0 | 1 |
| | (12) | 1 | 1 | 0 | 0 | 0 | 0 |
| | (13) | 1 | 1 | 0 | 1 | 0 | 0 |
| | (14) | 1 | 1 | 1 | 0 | 0 | 0 |
| | (15) | 1 | 1 | 1 | 1 | 0 | 0 |
| 0 | (0) | 0 | 0 | 0 | 0 | 1 | 0 |
| | (2) | 0 | 0 | 1 | 0 | 1 | 0 |
| | (4) | 0 | 1 | 0 | 0 | 1 | 0 |
| | (6) | 0 | 1 | 1 | 0 | 1 | 0 |
| | (8) | 1 | 0 | 0 | 0 | 1 | 0 |
| | (10) | 1 | 0 | 1 | 0 | 0 | 0 |
| | (11) | 1 | 0 | 1 | 1 | 0 | 1 |
| | (12) | 1 | 1 | 0 | 0 | 0 | 1 |
| | (13) | 1 | 1 | 0 | 1 | 0 | 1 |
| | (14) | 1 | 1 | 1 | 0 | 0 | 1 |
| | (15) | 1 | 1 | 1 | 1 | 0 | 1 |

FIG. 6

| ADDRESS STEP | AMPLITUDE DATA |
|---|---|
| 0 | 0000 ( = 0 ) |
| 1 | 0001 ( = 1 ) |
| 2 | 0010 ( = 2 ) |
| 3 | 0011 ( = 3 ) |
| 4 | 0100 ( = 4 ) |
| 5 | 0101 ( = 5 ) |
| 6 | 0110 ( = 6 ) |
| 7 | 0111 ( = 7 ) |
| 8 | 0111 ( = 7 ) |
| 9 | 0110 ( = 6 ) |
| 10 | 0101 ( = 5 ) |
| 11 | 0100 ( = 4 ) |
| 12 | 0011 ( = 3 ) |
| 13 | 0010 ( = 2 ) |
| 14 | 0001 ( = 1 ) |
| 15 | 0000 ( = 0 ) |

WAVEFORM INFORMATION GENERATING SYSTEM

BACKGROUND OF THE INVENTION

The present invention relates to a waveform information generating system using a waveform memory storing waveform information which determines a timbre or a tone color of a musical tone.

A system is conventionally known in which a waveform memory is assembled in an electronic musical instrument, waveform information stored in the memory is read out, and the waveform of a tone having a pitch corresponding to a depressed key is controlled in accordance with the corresponding readout waveform information. U.S. Pat. No. 3,515,792 discloses an example of such a system. In this system, since the speed for sequentially accessing the waveform memory from address 0 can be changed in accordance with a pitch of a desired tone, the timbre remains the same even if the pitch changes. Accordingly, the electronic musical instrument having such a system can provide only very monotonous tones and fails to allow a musical performance with various different and rich expressions.

SUMMARY OF THE INVENTION

It is an object of the present invention to provide a waveform information generating system which is capable of generating waveform information which can provide changes in rich timbre with only a simple configuration.

According to the waveform information generating system of the present invention, a waveform memory storing waveform information including a specific waveform information is accessed by address skip, so that waveform information different from the specific waveform information can be read out.

In order to achieve the above and other objects of the present invention, there is provided a waveform information generating system comprising: a waveform memory storing waveform information which is divided into a plurality of steps in accordance with a plurality of addresses thereof; means for inputting tone information; means for generating a tone clock signal having a frequency corresponding to the input tone information; means for generating a control signal which changes an address incrementing rate of the waveform memory; and means for generating a read signal for accessing the waveform memory in accordance with the tone clock signal and the control signal.

BRIEF DESCRIPTION OF THE DRAWINGS

FIG. 6 is a table showing the relationship between the address steps and amplitude data stored in the waveform memory.

DETAILED DESCRIPTION OF THE PREFERRED EMBODIMENTS

The preferred embodiments of the present invention will now be described with reference to the accompanying drawings.

Figure 1:
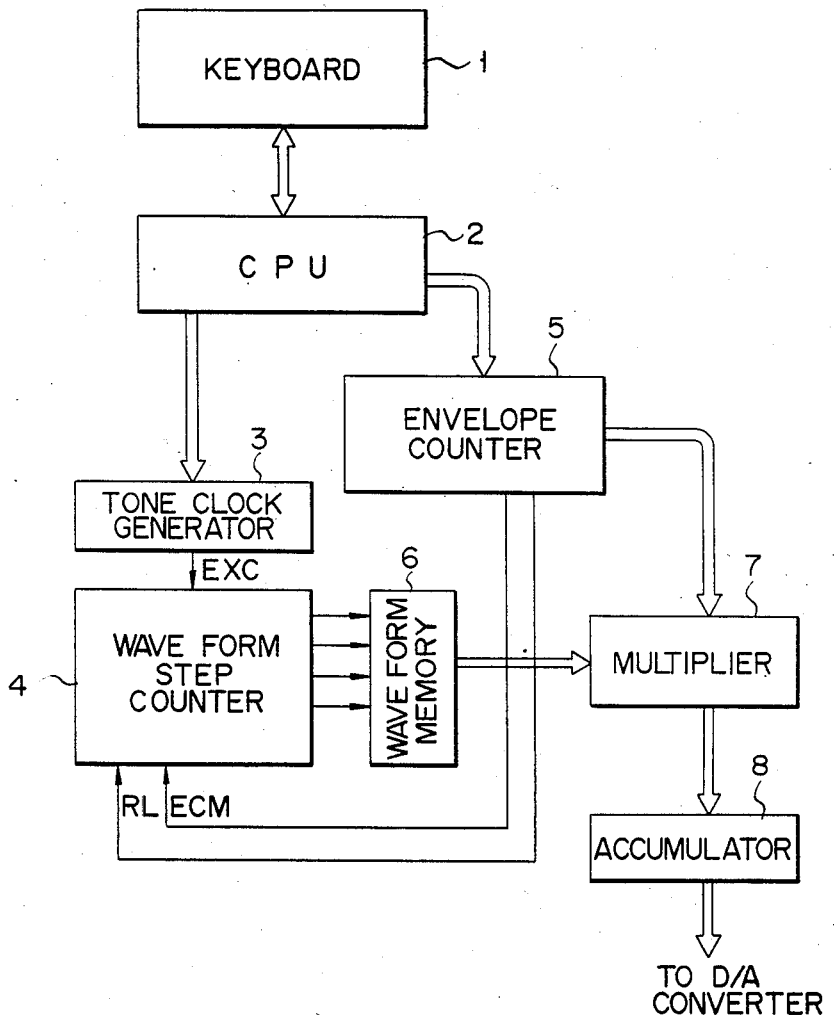
FIG. 1 is a block diagram of one embodiment of a waveform information generating system of the present invention.

FIG. 1 shows an embodiment wherein the present invention is applied to an electronic keyboard instrument. A keyboard 1 having a plurality of keys is key scanned by a control section, for example, a CPU 2; and tone information corresponding to a depressed key is supplied to the CPU 2. The tone information supplied to the CPU 2 is transferred to a tone clock generator 3. The tone clock generator 3 produces a tone clock EXC having a frequency corresponding to a pitch which is determined by an octave and a note of the received tone information. Note that the electronic keyboard instrument adopted in this embodiment is an electronic instrument which has an 8-tone polyphonic, 8-channel tone generation circuit. This circuit sequentially generates a maximum of 8 tone signals by 8-channel time-division, accumulates the generated tone signals and simultaneously produces the tone signals. Accordingly, the tone clock generator 3 is divided into 8 channels and can generate tone clocks having frequencies suitable for the corresponding tones within each channel duration in a time-division manner.

The tone clock EXC generated by the tone clock generator 3 is supplied to a waveform step counter 4. The waveform step counter 4 also receives from an envelope counter 5 a release signal RL and an envelope signal ECM which specifies the first or second half period for generating the release signal RL.

In accordance with the frequency of the tone clock EXC supplied from the tone clock generator 3, the waveform step counter 4 controls the address incrementing rate of a waveform memory 6 only when the envelope status indicates a release as will be described later. More specifically, when a 4-bit address signal generated by 8-channel time-division processing is supplied to the waveform memory 6, accessing is performed by address skip only when the envelope status indicates a release.

The waveform memory 6 has 16 address steps 0 to 15 and is accessed by a 4-bit address signal, as will be described later. Waveform information representing a predetermined amplitude of each step is read out from the waveform memory 6. The amplitude data of each step of waveform read out from the waveform memory 6 is supplied to one input terminal of a multiplier 7, the other input terminal of which receives an envelope signal from the envelope counter 5. The multiplier 7 calculates a product of the two input signals for each channel. An output from the multiplier 7 is supplied to an accumulator 8 which accumulates waveform information for a maximum of 8 tones. The accumulation result of the accumulator 8 is supplied to a D/A converter in the 8th channel duration. The accumulator 8 is then reset and resumes the accumulation operation. The amplitude information of a maximum of 8 channels which is converted into analog signals by the D/A converter is supplied to a loudspeaker which produces a maximum of 8 polyphonic sounds.

The detailed configuration of the waveform step counter 4 shown in FIG. 1 will now be described with reference to FIG. 2. The tone clock EXC from the tone clock generator 3 is supplied to one input terminal of each of AND gates 9, 10 and 11. An output from the AND gate 9 is supplied to a carry input terminal Cin of a 1-bit full adder 12 and to one input terminal of an AND gate 13. The other input terminal of the AND gate 13 receives one output q1 from a gate circuit 14. An output from the AND gate 13 is supplied to an input terminal B0 of the 1-bit full adder 12.

The gate circuit 14 receives the release signal RL and the envelope signal ECM which are supplied from the envelope counter 5 and also receives a 4-bit waveform address signal from 8-bit shift registers 15, 16, 17 and 18. The 4-bit waveform address signal is supplied to NAND gates indicated by hollow circles in the gate circuit 14 directly and also through inverters 19, 20, 21 and 22. The envelope signal ECM is supplied to other NAND gates of the gate circuit 14 directly and also through an inverter 23. The release signal RL is directly supplied to five more NAND gates of the gate circuit 14.

The read-in operation of the shift registers 15 to 18 is controlled in accordance with a clock $\phi 1$, and the read-out operation thereof is controlled in accordance with a clock $\phi 2$. The clocks $\phi 1$ and $\phi 2$ have the same frequency but are out of phase by 180°.

Figures 3, 4:
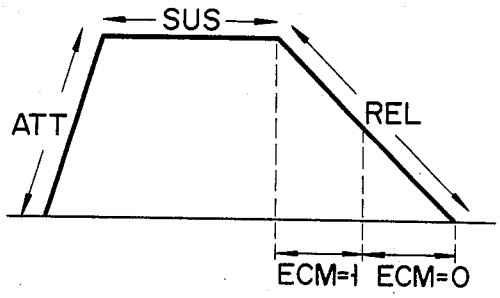
FIG. 3 is a chart showing the envelope used in the embodiment shown in FIG. 1.
FIG. 4 is a table for explaining the mode of operation of the circuit shown in FIG. 2.

The gate circuit 14 comprises a matrix connection of an input gate logic circuit section indicated by hollow circles and of an output gate logic circuit section indicated by solid circles. An output q2 from the output gate logic circuit section is supplied to the other input terminal of an AND gate 24. The release signal RL is supplied to and controls the five NAND gates of the gate circuit 14, which are coupled to five output lines 14*a* to 14*e*, respectively. The release signal RL is set at logic level "1" when the envelope status is in release mode REL and is set at logic level "0" when the envelope status is in the other modes, i.e., an attack mode ATT and a sustain mode SUS, as shown in FIG. 3. The envelope signal ECM is set at logic level "1" in the first half of the release duration and is set at logic level "0" in the second half thereof.

Outputs q1 and q2 from the gate circuit 14 having the configuration as described above have the states as shown in FIG. 4 in accordance with the state "1" or "0" of the envelope signal ECM and bit outputs from the shift registers 15 to 18.

An output from the AND gate 24 which is opened by the output q2 from the gate circuit 14 is supplied to the other input terminal of the AND gate 9 through an inverter 25 and to the other input terminal of the AND gate 10. An output from the AND gate 10 is supplied to one input terminal of an AND gate 27 through an inverter 26. The other input terminal of the AND gate 27 receives an output from an 8-bit shift register 28. An output from the AND gate 27 is fed back to the input terminal of the shift register 28 through an OR gate 29. The output from the shift register 28 is also supplied to the other input terminal of the AND gate 11 through an inverter 30. An output from the AND gate 11 is also supplied to the input terminal of the shift register 28 through the OR gate 29.

Outputs from the shift registers 15 to 18 are supplied to address input terminals of the waveform memory 6 and are also respectively supplied to an input terminal A0 of the 1-bit full adder 12 and input terminals A0, A1 and A2 of a 3-bit half adder 31. The input terminal B0 of the 1-bit full adder 12 receives an output from the AND gate 13. A sum obtained in the 1-bit full adder 12 is produced from an output terminal S0 thereof and is supplied to the input terminal of the shift register 15. A carry signal C from the full adder 12 is supplied to a carry input terminal Cin of the half adder 31.

Figure 5A:
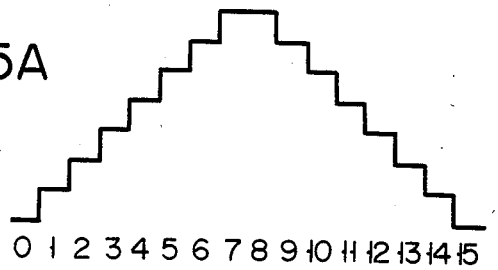
FIGS. 5A to 5C are charts showing different waveforms read out from the waveform memory, respectively.

The mode of operation of the embodiment described above will now be described. Although the system of this embodiment has an 8-tone polyphonic function, the following description will be made only with respect to a specific channel. It is assumed that waveform amplitude data changing in 16 steps is stored in the waveform memory 6, as shown in FIG. 5A. FIG. 6 shows the address steps 0 to 15 and the corresponding digital amplitude data.

When a specific key on the keyboard 1 is depressed, the CPU 2 detects the depressed key and supplies the corresponding tone information to the tone clock generator 3. In accordance with the received tone information, the tone clock generator 3 generates a tone clock EXC which is supplied to the waveform step counter 4. When the clock EXC is not generated, i.e., is at logic level "0", the inverter 26 opens the AND gate 27 shown in FIG. 2. The output from the shift register 28 circulates through the AND gate 27 and the OR gate 29. When the clock EXC goes to logic level "1", the output from the register 28 changes as will be described later.

Upon operation of the key, the output from the CPU 2 is supplied to the envelope counter 5. The output from the envelope counter 5 indicates an envelope as shown in FIG. 3. When the envelope status is in the attack or sustain mode ATT or SUS, the release signal RL supplied from the envelope counter 5 is at logic level "0" and the outputs q1 and q2 from the gate circuit 14 remain at logic level "0". In this state, the output from the AND gate 24 is at logic level "0" irrespective of the state of the output from the shift register 28. Accordingly, the output from the inverter 25 is kept at logic level "1". Then, the clock EXC is supplied to the carry input terminal Cin of the 1-bit- full adder 12 through the AND gate 9. Since the output from the AND gate 13 is also at logic level "0", the waveform address signal circulated and held by the shift registers 15 to 18 is sequentially incremented in accordance with the frequency of the tone clock EXC. The waveform information read out from the waveform memory 6 sequentially has the step amplitude value shown in FIG. 6 and has the waveform shown in FIG. 5A.

When the output from the envelope counter 5 is in the release mode REL as shown in FIG. 3, the output RL goes to logic level "1" and the envelope signal ECM also goes to logic level "1". Consequently, the outputs q1 and q2 having the states as shown in FIG. 4 are produced. When the tone clock EXC is generated when the bits of the waveform address signal from the shift registers 15 to 18 are all "0", the output q1 is at logic level "1" and the output q2 is at logic level "0". Then, the signal "1" is supplied to the 1-bit full adder 12 through the AND gate 13 and is added to the signal "1" received at the carry input terminal Cin of the full adder 12. The sum obtained at the full adder 12 becomes 2. Thus, the waveform address signal output from the shift registers 15 to 18 becomes "0010". In like manner, the waveform address signal is incremented in increments of 2 to change the step in the order of 0, 2, 4, 6 and 8. When the step is 8, the output q1 goes to logic level "0" and the output q2 goes to logic level "0". At this time, since the output from the shift register 28 is at logic level "1", the output from the AND gate 24 is at logic level "1" and the output from the AND gate 9 is at logic level "0".

When the clock EXC is supplied in this state, the output from the AND gate 10 goes to logic level "1" and the input to the shift register 28 goes to logic level "0". Thereafter, the content of the shift register 28 is kept at logic level "0". Since the AND gate 9 is closed, the clock EXC does not provide any change to the waveform address signal and keeps specifying step 8 during the duration of the clock EXC.

When the next tone clock EXC is supplied, since the output from the shift register 28 is at logic level "0", the output from the AND gate 24 is at logic level "0" and the AND gate 9 is opened. Then, the waveform address signal is incremented by 1 and step 9 is designated. Since the output from the inverter 30 is at logic level "1" at this time, the tone clock EXC is supplied to the shift register 28 through the AND gate 11 and the OR gate 29. Thereafter, the content of the shift register 28 is kept at logic level "1".

As a result, the output from the waveform memory 6 in step 8 has a duration twice that of steps 0 to 7. Similarly, steps 9, 10 and 11 have the same duration as that of step 8. Step 12 is then designated.

Figure 5B:
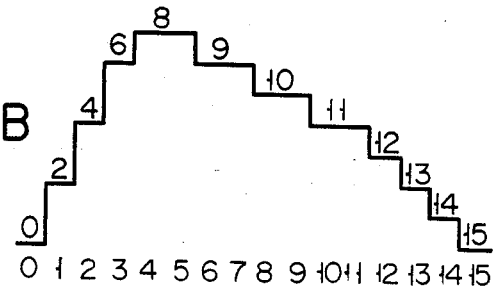

In step 12, the output from the shift register 28 is at logic level "1". However, since the outputs q1 and q2 from the gate circuit 14 are both at logic level "0", a signal "0" is supplied to the input terminal B0 of the 1-bit full adder 12. When the tone clock EXC is supplied, it is supplied to the carry input terminal Cin of the full adder 12. The waveform address signal is incremented by 1 to restore the original duration, and the readout output of step 12 is obtained. In the same manner, the waveform address signal is incremented in unitary increments to designate steps 14 and 15, and the waveform changes as shown in FIG. 5B.

Figure 5C:
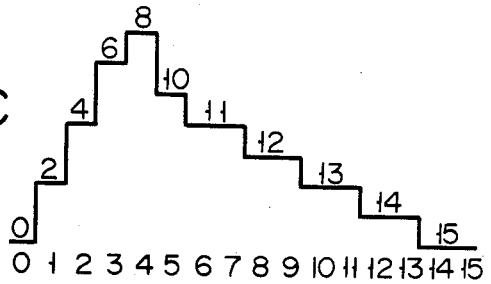

When the first half of the release duration ends in this manner, the signal ECM goes to logic level "0". As a consequence, the outputs q1 and q2 from the gate circuit 14 change as shown in FIG. 4. The waveform address signal from the waveform memory 6 changes in the order of steps 0, 2, 4, 6, 8 and 10, and steps 11, 12, 13, 14 and 15 have the duration twice that of steps 0 to 10. In the second half of the release duration, the memory output as shown in FIG. 5C is obtained.

As described above, in the release duration of the envelope, the waveform information to be read out from the waveform memory is read out by partial address skip, so that information indicating different waveforms is obtained. Especially, different waveform information is obtained in the first and second halves of the release duration. This indicates that the timbre of a tone during the release duration changes after the finger of the operator is released from the depressed key of the keyboard 1.

In the above description, the timbre of a tone is changed in the release duration of the envelope. However, if a control signal which goes to logic level "1" in the attack mode ATT is supplied from the envelope counter 5 to the gate circuit 14 in place of the signal RL, the timbre of a tone can be similarly changed in the attack mode ATT. Although the timbre is changed by changing in two steps the signal ECM in the release duration in the above embodiment, it can be changed in a plurality of steps.

Figure 7:
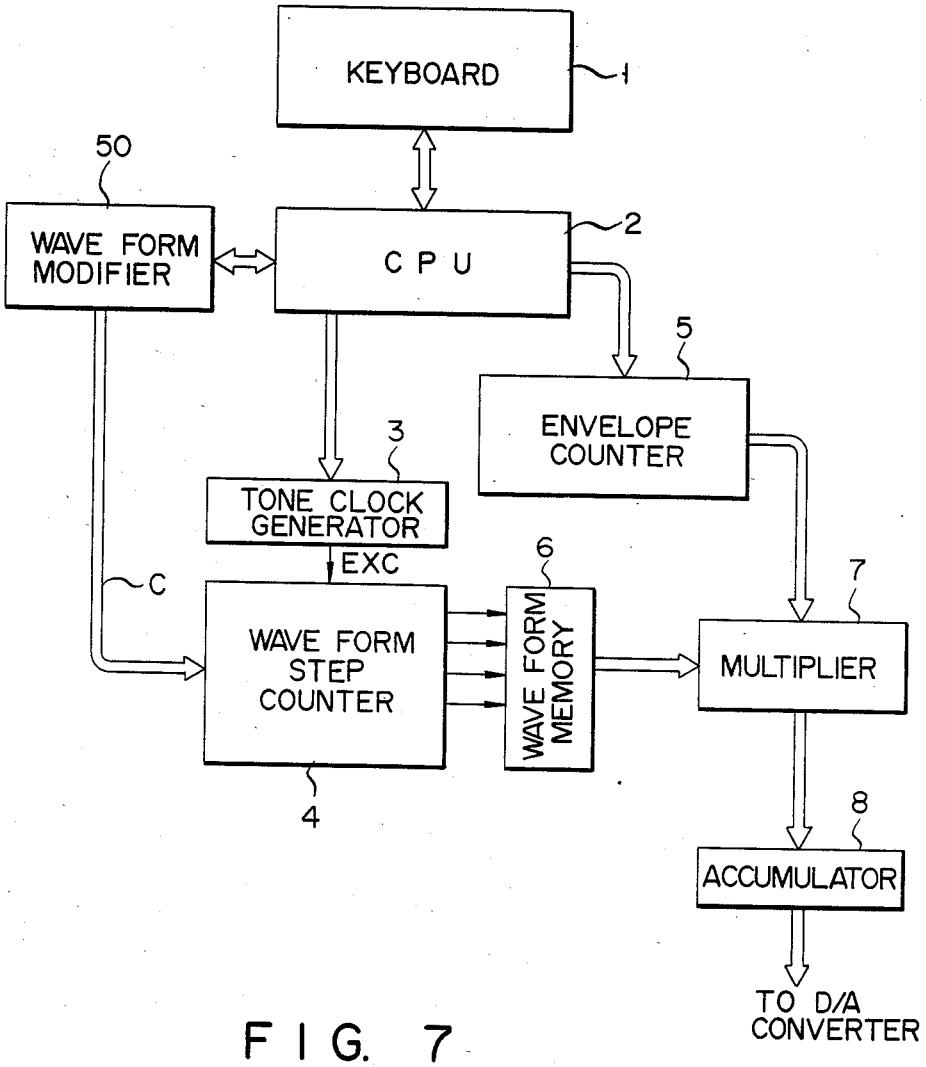
FIG. 7 is a block diagram showing another embodiment of the present invention.

Another embodiment of the present invention will now be described with reference to FIG. 7. The same reference numerals as used in FIG. 1 denote the same parts in FIG. 7, and a detailed description thereof will be omitted. The waveform step counter 4 shown in FIG. 7 has the same configuration as that shown in FIG. 2. However, the waveform step counter 4 shown in FIG. 7 receives a control signal C from a waveform modifier 50 in place of the signals RL and ECM supplied as control signals from the envelope counter 5 shown in FIG. 1. The waveform modifier 50 can comprise a random signal generating circuit or the like. The random signal generating circuit 50 generates two control signals C which change randomly. The control signals C are supplied to the gate circuit 14 in place of the signals RL and ECM shown in FIG. 2. In this case, since the control signals C are supplied to the waveform step counter 4 irrespective of changes in the envelope from the envelope counter 5, the waveform address signal supplied to the waveform memory 6 changes randomly and the timbre of a produced tone also changes randomly.

The waveform modifier 50 may have a configuration such that control signals are obtained which change in accordance with a pressure or depressed speed of a depressed key of the keyboard 1 and the timbre of a tone is changed in accordance with the pressure or depressed speed of the key. In order to achieve this configuration, a pressure sensor is incorporated in association with the keys of the keyboard 1. An output from the pressure sensor is converted into a digital signal by the waveform modifier 50, and the digital signal is used as a control signal in place of the signal ECM.

A touch response providing apparatus described in U.S. patent application Ser. No. 330,843 filed on Dec. 15, 1981, and now U.S. Pat. No. 4,416,178, may be used in the waveform modifier 50. Another touch response providing apparatus shown in U.S. Pat. No. 4,079,651, or U.S. Pat. No. 4,362,934 may also be used in the waveform modifier 50.

A still another waveform modifier 50 may be used, in which the performance keys of the keyboard 1 are divided into groups, and different signals are generated by operating the corresponding keys belonging to the groups, thereby obtaining different timbres. For example, an octave code representing an octave, which is included in a key code obtained by operating the keyboard 1, may be used for generating the control signal C.

Figure 2:
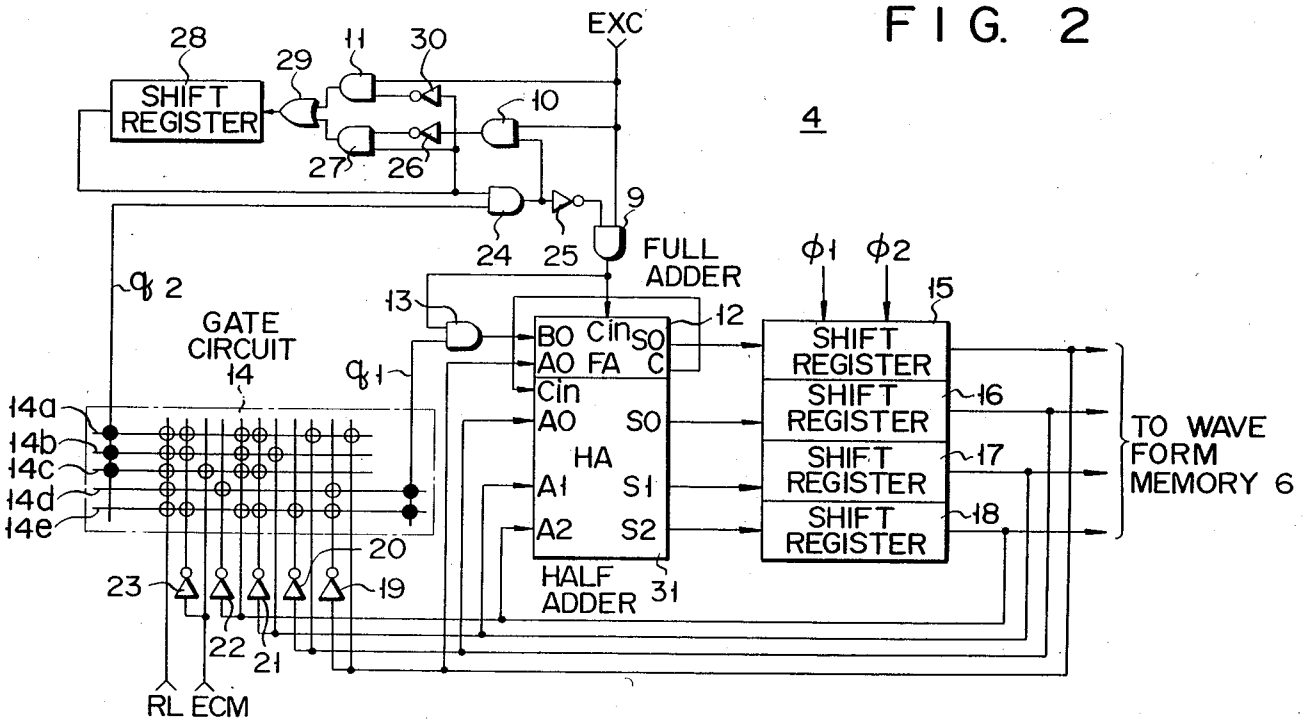
FIG. 2 is a block diagram showing details of the configuration of a waveform step counter shown in FIG. 1.

In the embodiment shown in FIG. 2, the waveform step counter 4 produces a 4-bit address signal to provide 16 steps of change in a waveform. However, when the bit number of the address signal is further increased, more complex addressing of the waveform memory 6 can be performed and a more complex change in the timbre of a tone can be obtained.

What is claimed is:

1. A waveform information generating system comprising:

a waveform memory means for storing waveform information, and which is divided into a plurality of steps in accordance with a plurality of addresses thereof;

tone information inputting means for inputting tone information;

tone clock signal generating means coupled to said tone information inputting means for generating a tone clock signal having a frequency corresponding to the input tone information;

control signal generating means for generating a control signal which changes an address incrementing rate of said waveform memory means; and read signal generating means coupled to said tone clock signal generating means and to said control signal generating means, said read signal generating means including:

an address counting means for generating a read signal to access said waveform memory means by counting the tone clock signal supplied from said tone clock signal generating means; and control means for controlling the incrementing rate of said counting means, when said tone clock signal is supplied to said address counting means, in accordance with said control signal delivered from said control signal generating means, thereby generating a waveform other than a waveform stored in said waveform memory means.

2. A system according to claim 1, wherein said control signal generating means generates said control signal in accordance with an envelope status of envelope information for controlling an envelope of the waveform.

3. A system according to claim 1, wherein said control signal generating means includes a random signal generating circuit.

4. A system according to claim 1, wherein said control signal generated by said control signal generating means has a content corresponding to depressing conditions of a depressed key of said tone information inputting means.

5. A waveform information generating system comprising:

a waveform memory means for storing information of a waveform, and which is divided into a plurality of steps in accordance with a plurality of addresses thereof;

tone information inputting means for inputting tone information;

tone clock signal generating means for generating a tone clock signal having a frequency corresponding to the input tone information;

control signal generating means for generating a control signal which changes an address incrementing rate of said waveform memory means; and read signal generating means for generating a read signal for accessing said waveform memory means in accordance with the tone clock signal and the control signal, said read signal generating means including:

a plurality of shift registers, each shift register having a predetermined number of stages;

a gate circuit means which receives output bits from said shift registers and the control signal, and which produces first and second output signals;

a first gating means which is gate-controlled in accordance with said first output signal and said tone clock signal; and an address calculation circuit means which receives said second output signal, an output signal from said first gating means, and output bits from said shift registers, and which includes means for performing a predetermined address calculation.

6. A system according to claim 5, wherein said plurality of shift registers are connected in parallel with each other.

* * * * *